US006217381B1

(12) United States Patent
Kameyama

(10) Patent No.: US 6,217,381 B1
(45) Date of Patent: Apr. 17, 2001

(54) CONNECTOR FOR A COAXIAL CABLE AND ITS CONNECTING METHOD

(75) Inventor: Isao Kameyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/441,234

(22) Filed: Nov. 16, 1999

(30) Foreign Application Priority Data

Nov. 17, 1998 (JP) ..... 10-326541

(51) Int. Cl.[7] ..... H01R 9/05
(52) U.S. Cl. ..... 439/578; 439/610
(58) Field of Search ..... 439/578, 579, 439/580, 581, 582, 583, 584, 585, 596, 610

(56) References Cited

U.S. PATENT DOCUMENTS

| | | | | |
|---|---|---|---|---|
| 3,399,373 | * | 8/1968 | Maki et al. | 439/596 |
| 4,101,187 | * | 7/1978 | Collier | 439/596 |
| 4,995,836 | * | 2/1991 | Toramoto | 439/675 |
| 5,110,308 | | 5/1992 | Nishikawa et al. | 439/582 |

FOREIGN PATENT DOCUMENTS

| | | |
|---|---|---|
| 1-60481 | 4/1989 | (JP) . |
| 5-90855 | 12/1993 | (JP) . |
| 7-73937 | 3/1995 | (JP) . |

* cited by examiner

*Primary Examiner*—Gary F. Paumen
*Assistant Examiner*—Alexander Gilman
(74) *Attorney, Agent, or Firm*—Armstrong, Westerman, Hattori, McLeland & Naughton, LLP

(57) ABSTRACT

A connector for a coaxial cable consists of a terminal provided with a connection, an insulating terminal holder for receiving the terminal, which has a pair of opposed first and second lids at one end at a side wherefrom to receive the terminal, the first lid, when closed, locking the terminal in the terminal holder, and a conductive shield cover mounted on the terminal holder, the shield cover having a holding means at one end toward the coaxial cable, the connection hole of the terminal and the holding means being aligned with each other when the shield cover is mounted on the terminal holder, wherein when the coaxial cable is advanced, the conductor is inserted into the connection hole and the braid is located on the holding means to position the conductor and the braid at one time. The load on the conductor is reduced, the manufacturing process is simplified, and reliability is improved.

9 Claims, 17 Drawing Sheets

CONNECTOR FOR A COAXIAL CABLE AND ITS CONNECTING METHOD

BACKGROUND OF THE INVENTION

1. Field of the Invention

This invention relates to a connector for a coaxial cable and its connecting method.

2. Description of the Related Art

A method of connecting a connector to a coaxial cable such as shown in FIG. 17 has been conventionally proposed. This method consists of folding the braid 81*b* of a coaxial cable 81 back on the sheath 81*c*, inserting into a connection hole 82*a* of a terminal 82 and bending the conductor 81*a* of the coaxial cable 81, and soldering and electrically connecting the conductor 81*a* to the terminal 82, so as to produce a terminal-attached cable 80.

The terminal-attached cable 80 is placed on a pair of holder bodies 83*a*, 83*a* of an insulating terminal holder 83, and the pair of holder bodies 83*a*, 83*a*, as shown in FIG. 18, are closed to fix the terminal-attached cable 80 therein and provide a holder-attached cable 84. As shown in FIG. 19, the holder-attached cable 84 is inserted into a conductive sleeve 85 from the rear, and the latter is then crimped on and electrically connected to the folded-back braid 81*b*. After completion of the crimping, that part of the braid 81*b* exposed from the sleeve 85 is cut with a cutting means and removed to provide a connector-attached coaxial cable 86.

With the method as mentioned above, however, the process from soldering the conductor 81*a* to the terminal 82 to crimping the sleeve 85 onto the braid 81*b*, as apparent from FIGS. 17 to 19, involves setting the terminal-attached cable 80 in the terminal holder 83 and setting the holder-attached cable 84 in the sleeve 85, during each of which load tends to be imposed on the conductor 81*a*, possibly resulting in impairment of quality. Besides, the method, due to its complexity, is not adapted for automating, resulting in a poor production efficiency.

Further, another method of connecting a coaxial cable connector such as shown in FIG. 20 has been proposed in U.S. Pat. No. 5,110,308. This method includes inserting the coaxial cable 81 into the adapter portion 92 of a T-shaped housing 91 and inserting the conductor 81*a* into a connection hole 93*a* of the terminal portion 93 inside the housing 91 for electrically connecting the conductor 81*a* to the terminal portion 93.

The adapter portion 92 is pushed in between the insulator 81*d* and the braid 81*b*, followed by, as shown in FIG. 21, bending the sleeve portion 94 of the housing 91 toward the coaxial cable. The braid crimp piece 94*a* of the sleeve portion 94 is crimped on the braid 81*b* to electrically connect the sleeve portion 94 to the braid 81*b*. A connector-attached cable 90 is thus obtained.

With the method as mentioned above, however, because the terminal portion 93, adapter portion 92 and sleeve portion 94, as apparent from FIGS. 20 and 21, are provided in one piece by molding, an insulating member 95 needs to be inserted around the terminal portion 93 to prevent a short circuit between the terminal portion 93 connected to the conductor 81*a* and the sleeve 94 connected to the braid 81*b*, which is troublesome. Further, because the method involves bending the sleeve portion 94, the coaxial cable 81 may erroneously get damaged or the housing 91 may be deformed during the bending operation, resulting in lowered reliability of the product.

SUMMARY OF THE INVENTION

This invention has been accomplished to overcome the above drawbacks and an object of this invention is to provide a connector for a coaxial cable which attains a reduced load on the conductor of a coaxial cable after its connection to the related terminal, which is produced by a simplified manufacturing process, and which keeps the product from being lowered in reliability.

In order to attain the object, according to an aspect of this invention, there is provided a connector for a coaxial cable, the coaxial cable including a conductor, an insulator around the conductor, a braid around the insulator, and a sheath around the braid, which comprises: a terminal provided with a connection hole into which the conductor of the coaxial cable is inserted for electrical connection with the terminal; an insulating terminal holder including a holder body for receipt therein of the terminal and a pair of opposed first and second lids provided at one end of the holder body at a side wherefrom the terminal is received into the holder body, the first lid, when closed, locking the terminal in the holder; and a conductive shield cover including a cover body detachably mounted on the terminal holder inclusive of the first lid in the closed position and a holding means provided at one end of the cover body toward the coaxial cable, the connection hole of the terminal and the holding means being longitudinally aligned with each other when the cover body is mounted on the terminal holder, wherein when the coaxial cable is advanced toward the terminal, after the terminal is locked in the holder body by the first lid and the shield cover is mounted on the terminal holder, the conductor is inserted into the connection hole of the terminal and the braid is located on the holding means so as to position the conductor relative to the terminal and the braid relative to the shield cover at one time, and the second lid is then closed to cooperate with the first lid to hold the insulator therebetween.

Preferably, the connector further comprises a sleeve for receiving the terminal holder with the shield cover, the sleeve having a braid-holding means crimped on and connected to the braid located on the holding means.

Preferably, the holding means of the shield cover comprises a pair of opposed holding pieces having as a whole a shape equal to that of the insulator so as to get between the insulator and the braid on advancement of the coaxial cable toward the terminal.

Preferably, the first lid has at a side toward the holder body a terminal locking projection for locking the terminal in the holder body and at a side remote from the holder body a holding rib, and the second lid has at a side remote from the holder body a corresponding holding rib, the holding ribs of the first and second lids cooperating with each other to hold the insulator therebetween.

Advantageously, one of the holding ribs of the first and second lids has a locking indentation for pressing therein the insulator when the holding ribs of the first and second lids hold the insulator therebetween.

Advantageously, the second lid is lockingly engageable with the shield cover when the second lid is closed, through corresponding locking means provided on the second lid and the shield cover.

According to another aspect of this invention, there is provided a method of connecting a connector to a coaxial cable, the coaxial cable including a conductor, an insulator around the conductor, a braid around the insulator, and a sheath around the braid, which comprises the steps of: inserting a terminal into an insulating terminal holder, the terminal having a connection hole into which the conductor of the coaxial cable is inserted; locking the terminal in the terminal holder; mounting a conductive shield cover on the terminal holder, which shield cover has a holding means, such that the connection hole of the terminal and the holding means are longitudinally aligned with each other; and advancing the coaxial cable along a straight line toward the terminal to have the conductor inserted into the connection hole of the terminal and the braid located on the holding means so as to position the conductor relative to the terminal and the braid relative to the shield cover at one time.

Preferably, the method further comprises the step of soldering the conductor to the terminal at the connection hole.

Preferably, the method further comprises the step of inserting the terminal holder with the shield cover into a sleeve provided with a braid-holding means, and crimping the braid-holding means on the braid located on the holding means of the shield cover.

The above and other objects, features and advantages of this invention will become apparent from the following description and the appended claims, taken in conjunction with the accompanying drawings.

BRIEF DESCRIPTION OF THE DRAWINGS

FIG. 11 is a sectional view of the cover-attached terminal, with the coaxial cable fully pushed in;

DESCRIPTION OF THE PREFERRED EMBODIMENTS

Embodiments of this invention will now be described with reference to the attached drawings.

FIGS. 1 to 16 show one embodiment of a connector for a coaxial cable according to this invention.

Figure 1:
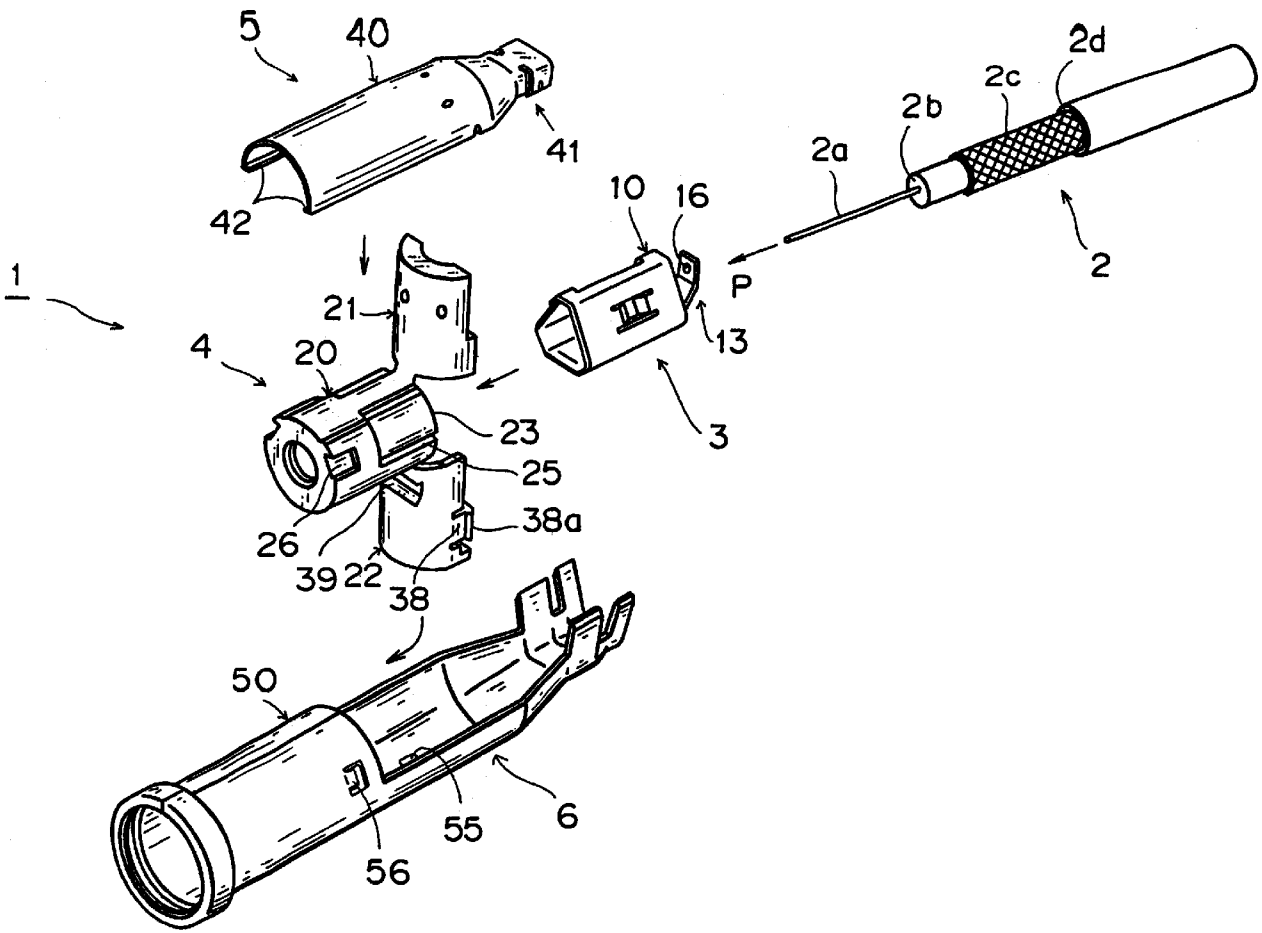
FIG. 1 is an exploded perspective of a connector for a coaxial cable according to one embodiment of this invention.

As shown in FIG. 1, a connector 1 for a coaxial cable 2 is made up of a conductive terminal 3 which connects to a conductor 2*a* of the coaxial cable 2, an insulating terminal holder 4 for receiving the terminal 3, a conductive shield cover 5 which protects the terminal holder 4, and a conductive sleeve 6 which receives the terminal holder 4 and the shield cover 5 and connects to a braid 2*c* of the coaxial cable 2.

The coaxial cable 2 consists of the conductor 2*a*, an insulator 2*b* covering the outer periphery of the conductor 2*a*, the braid 2*c* provided circumferentially around the outer periphery of the insulator 2*b*, and an insulating sheath 2*d* covering the braid 2*c*.

Figure 2A:
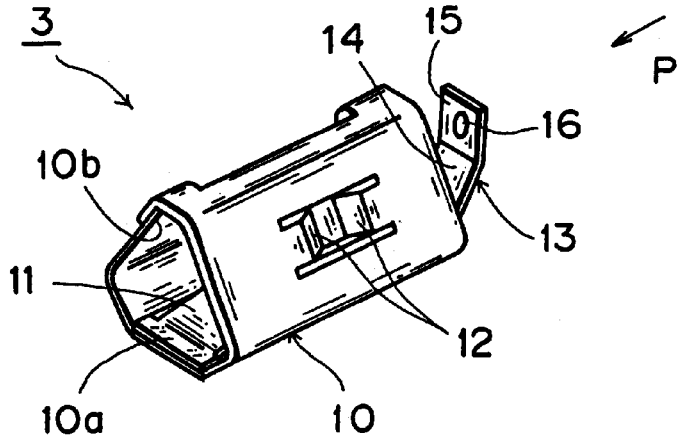
FIG. 2A is a perspective view of a terminal in FIG. 1.
Figure 2B:
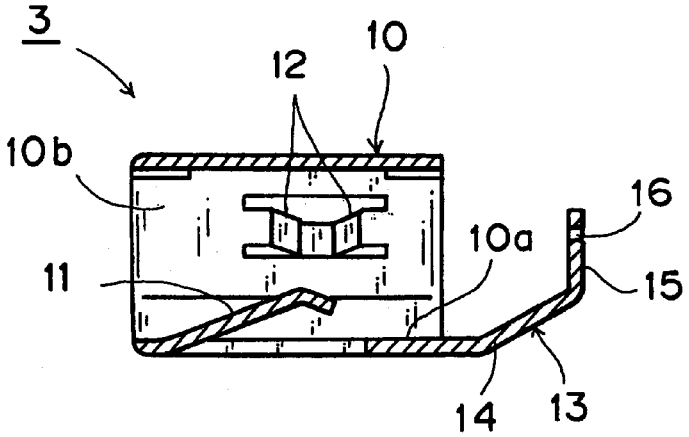
FIG. 2B is a sectional view of the terminal.

The terminal 3 as in FIGS. 1 and 2 is formed of a stamped conductive metallic plate.

The terminal 3 consists of a hollow terminal body 10 of rectangular cross section, a resilient contact 11 cut and raised from a bottom wall 10*a* of the terminal body 10, connection pieces 12 stamped to project inwardly from both inclined walls 10*b* of the terminal body 10 for connection to a mating terminal (not shown), and an integral contact 13 extending outwardly at a rear end of the bottom wall 10*a*. Incidentally, the terminal body 10 may be of arbitrary shape in cross section.

The contact 13 includes an extension plate portion 14 extending upwardly from the bottom wall 10*a* and a connection plate portion 15 integral with the extension plate portion 14. The connection plate portion 15 is located substantially perpendicularly to an insertion direction P of the coaxial cable 2 into the terminal 3 and has a central connection hole 16, so that the advancement of the coaxial cable 2 directly toward the connection hole 16 makes an automatic insert of the conductor 2*a* into the connection hole 16. In this case, because the conductor 2*a*, after its insertion into the connection hole 16, needs not to be bent as in the described related art, the insertion operation can be done in a less time-and effort-consuming manner.

Figure 3A:
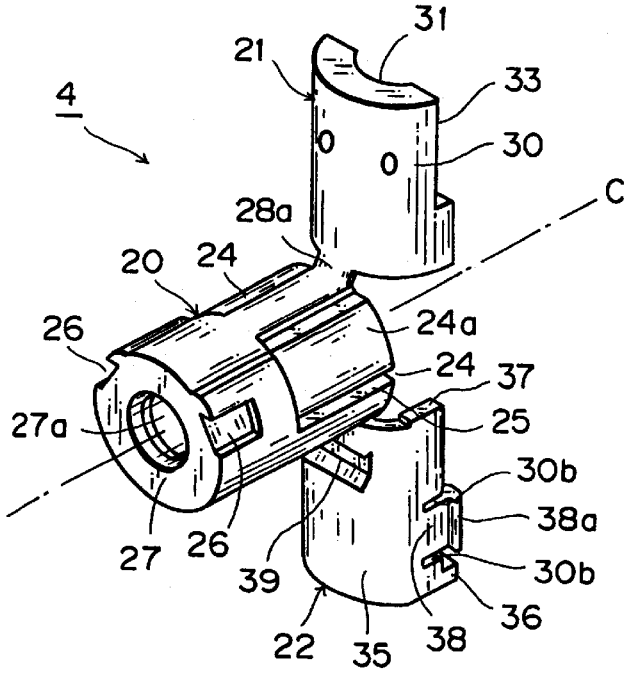
FIG. 3A is a perspective view of a terminal holder in FIG. 1, with its upper and lower lids shown opened.
Figure 3B:
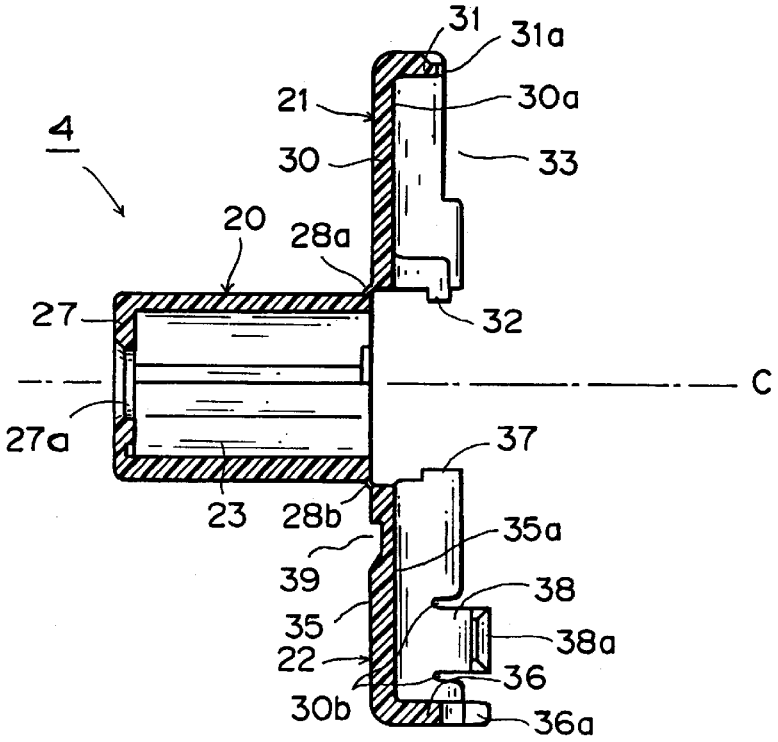
FIG. 3B is a sectional view of the terminal holder.
Figure 4A:
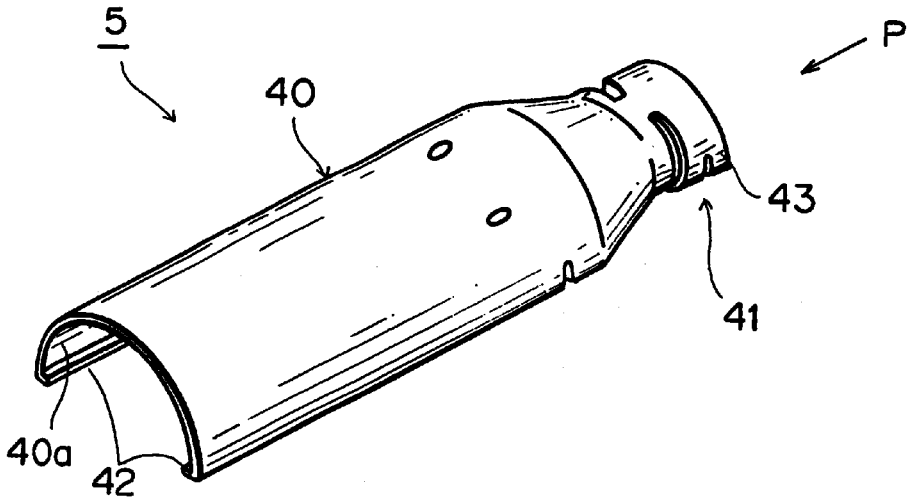
FIG. 4A is a perspective view of a shield cover in FIG. 1.
Figure 4B:
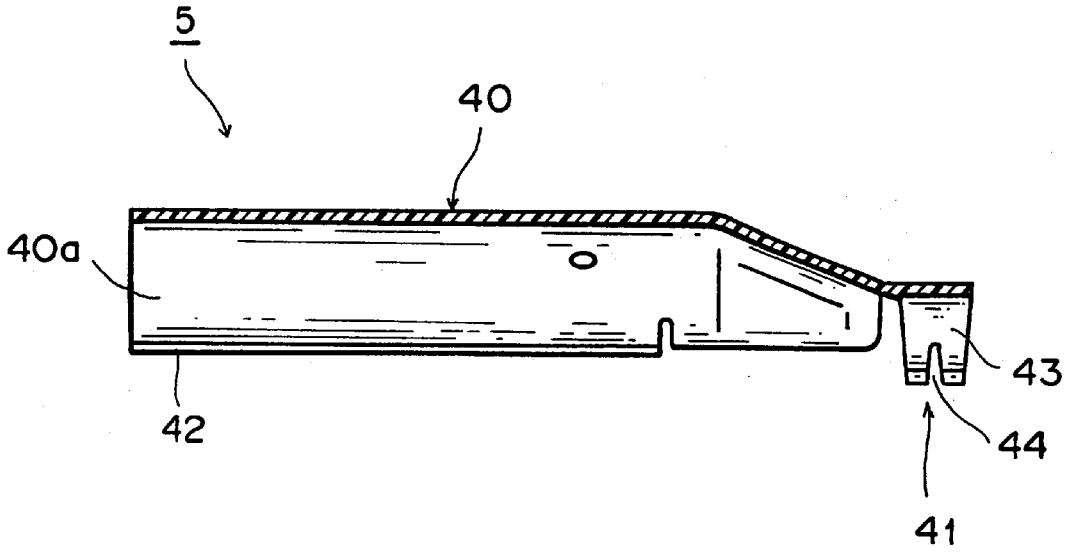
FIG. 4B is a sectional view of the shield cover.

As shown in FIGS. 1 and 3, the terminal holder 4 consists of a cylindrical holder body 20, and a pair of opposed upper and lower lids 21 and 22 hinged at the rear end of the holder body 20.

The holder body 20 has a terminal receiving cavity 23 formed therein which receives through the rear end the terminal 3. The holder body 20 has a pair of placement recesses 24, 24 formed on its outer periphery toward the rear end. There are a pair of locking grooves 25, 25 formed on respective placement recess bottom surfaces 24*a*, 24*a* which extend parallel to a center axis C of the holder body 20. The holder body 20 is provided on its outer periphery at the front end with a pair of locking grooves 26, 26. The holder body 20 has a flange 27 extending circumferentially inwardly at the front end, the flange having a central hole 27*a* for insertion therethrough of the not-shown mating terminal.

The upper and lower lids 21 and 22 are provided in the form of a cylinder divided into halves and are joined via respective hinges 28*a* and 28*b* to the rear end of the holder body 20 in an open/close manner.

The upper lid 21 consists of a split-cylinder-shaped body 30, a holding rib 31 provided projecting on the inner surface 30*a* at the rear end of the body 30, a pair of terminal locking projections 32 provided at the front end of the body 30, and receiving cutouts 33 formed at both side edges of the body 30 toward the rear end.

On closing the upper lid 21, the holding rib 31 is located transversely (substantially perpendicularly) to the center axis C of the holder body 20. The holding rib 31 has a flat free (inner) end surface 31*a*. The pair of opposed terminal locking projections 32 extend from the inner surface 30*a* at the front end of the upper lid body 30 so that on inserting the terminal 3 into the terminal receiving cavity 23 and closing the upper lid 21, the pair of terminal locking projections 32 come into contact with the terminal 3 to lock same in the terminal receiving cavity 23. The terminal 3 is thus prevented from slipping off rearwardly.

The lower lid 22 consists of a split-cylinder-shaped body 35, a holding rib 36 provided projecting on the inner surface 35*a* at the rear end of the body 35, stoppers 37 formed at the front end of the body 35, cover-locking projections 38 provided at both sides of the body 35, and a positioning groove 39 located on the outer periphery of the body 35.

On closing the lower lid 22, the holding rib 36 is located transversely (substantially perpendicularly) to the center axis C of the holder body 20. The holding rib 36 has at the free (inner) end a locking indentation 36*a* of the same diameter as the insulator 2*b*, so that on closing the upper and lower lids 21 and 22, the insulator 2*b* is pressed by the inner end 31*a* of the holding rib 31 and fixed in the locking indentation 36*a* of the holding rib. The insulator 2*b* is thus prevented from positional deviation.

Each cover-locking projection 38 is longitudinally defined by slits 30*b* so that the projection 38 is deflectable relative to the lower lid body 35 in the direction transverse to the center axis C. The cover-locking projections 38 have integral cover-locking claws 38*a* projecting outwardly at their free end.

The stoppers 37 are for keeping the front end of the lower lid body 35 from contact with the rear end of the holder body 20 when the lower lid 22 is closed.

As shown in FIGS. 1 and 4, the shield cover 5 consists of a cover body 40 shaped like a half cylinder with a tapered rear end, a holder portion 41 located at the rear end, and locking claws (or ribs) 42 extending longitudinally on the inner surface at both lateral ends of the cover body 40. It is designed that the cover body 40, when assembled, has its intermediate portion cover the closed upper lid 21, with its front end located on the holder body 20 at the rear end.

The holder portion 41 includes a pair of holder pieces 43, 43, each with a slit 44, projecting inwardly (downwardly on the drawing of FIG. 4B) at the rear end of the cover body 40. The pair of holder pieces 43, 43 are provided in such an arrangement as to hold the insulator 2*b* therebetween and are spaced from each other by a distance equal to the diameter of the insulator 2*b*. Consequently, if the coaxial cable 2 is inserted from the rear end side of the cover body 40, the pair of holder pieces 43, 43 slide on the insulator 2*b* and advance in between the insulator 2*b* and the braid 2*c*, thereby making it possible to position the braid 2*c* relative to the cover body 40.

In this case, if the pair of holder pieces 43, 43 are sharpened (angled acutely) at the side toward the incoming coaxial cable 2, their insertion in between the insulator 2*b* and the braid 2*c* will be more easily attained, such pair of holder pieces 43, 43 successfully raising the braid 2*c* from the insulator 2*b*.

Figure 14:
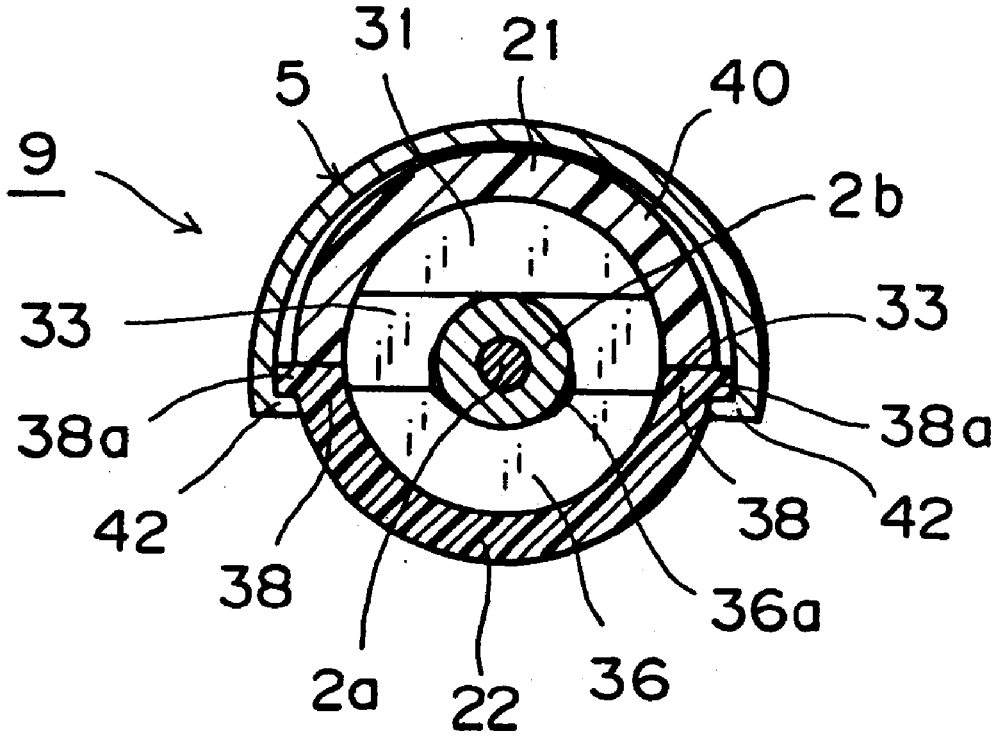
FIG. 14 is a sectional view taken along the line D—D of FIG. 13A.

As will be later described, the locking claws 42 of the shield cover 5 engage in the respective locking grooves 25 formed on the holder body 20 and engage with the respective cover-locking claws 38*a* of the lower lid 22 when the lower lid 22 is in closed position. The cover-locking projections 38 are deflected inwardly to bring their cover-locking claws 38*a* into engagement with their respective locking claws 42 (FIG. 14).

Figure 5A:
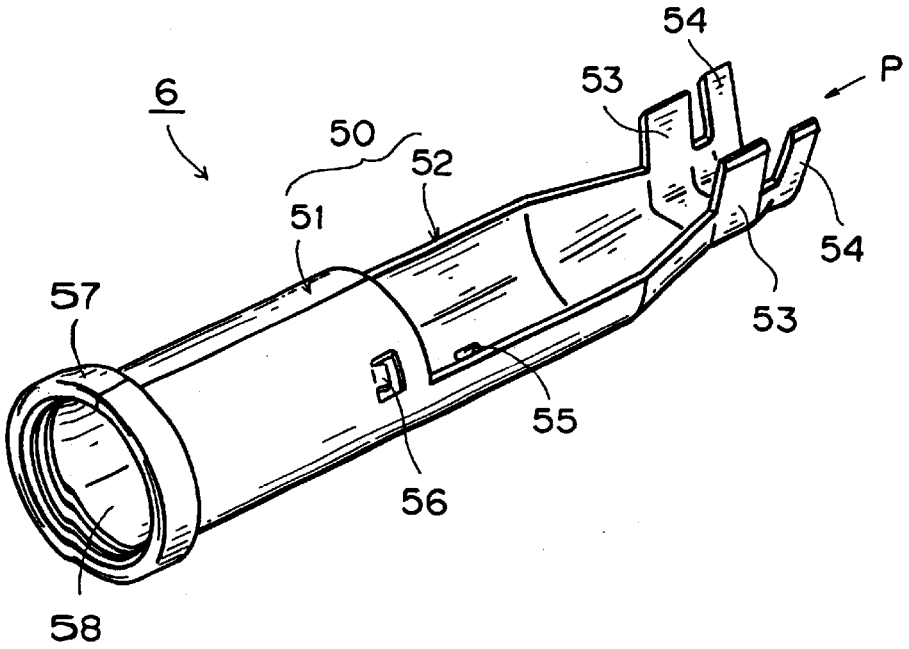
FIG. 5A is a perspective view of a sleeve in FIG. 1.
Figure 5B:
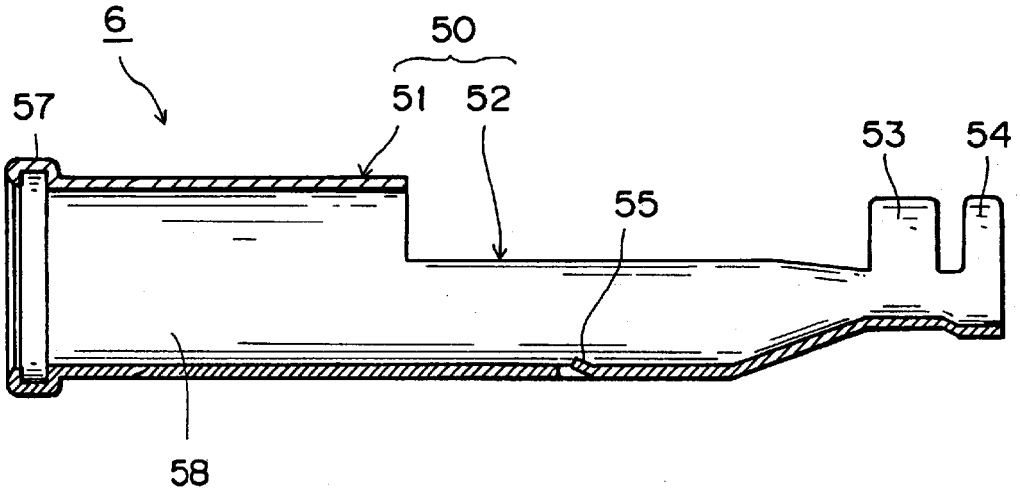
FIG. 5B is a sectional view of the sleeve.

As shown in FIGS. 1 and 5, the sleeve 6 includes a sleeve body 50 made up of a cylindrical portion 51 and a trough-shaped portion 52 extending at the rear end of the cylindrical portion 51, a pair of braid-holding pieces 53, 53 and a pair of sheath-holding pieces 54, 54 provided upright at the trough-shaped portion 52 of the sleeve body 50, the latter located on an outer side in the insertion direction P of the coaxial cable 2, a holder-positioning piece 55 provided at the trough-shaped portion 52, holder-locking pieces 56 formed at the cylindrical portion 51 of the sleeve body 50, and a collar 57 provided circumferentially around the sleeve body 50 at the front end. Inside the cylindrical portion 51 is formed a terminal receiving space 58 for receipt therein of the mating terminal.

The holder-locking pieces 56 engage in the respective locking grooves 26 of the holder body 20 and the holder-positioning piece 55 engages in the positioning groove 39 of the closed lower lid 22, so that the terminal holder 4 is reliably locked in position in the sleeve 6.

The method of connecting the connector 1 to the coaxial cable 2 will now be described.

The sheath 2*d* is stripped off at one end of the coaxial cable 2 to have the conductor 2*a*, the insulator 2*b* and the braid 2*c* exposed as shown in FIG. 1.

Figure 6A:
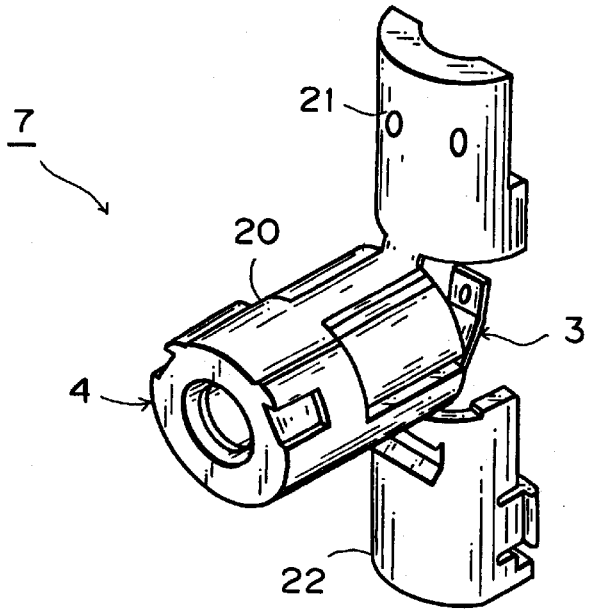
FIG. 6A is a perspective view of a holder-attached terminal assembled from parts in FIG. 1.
Figure 6B:
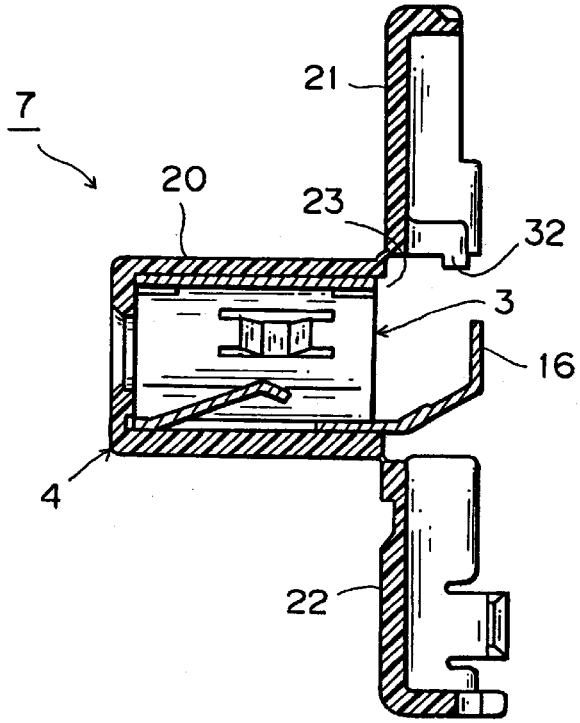
FIG. 6B is a sectional view of the holder-attached terminal.
Figure 7A:
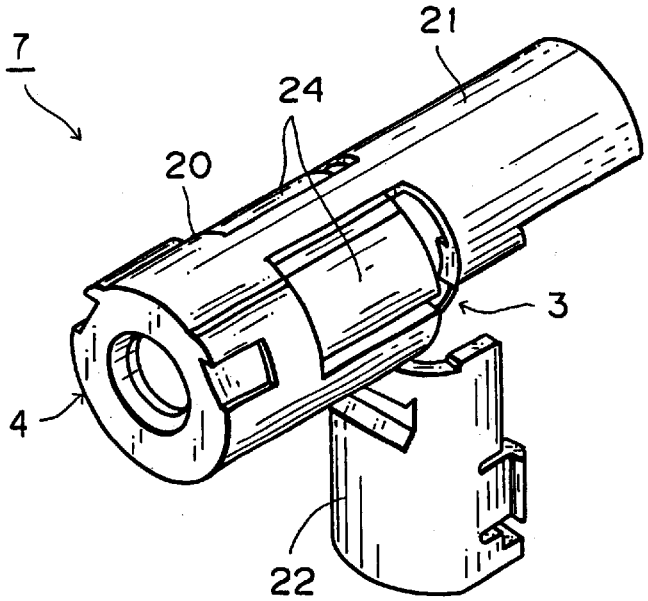
FIG. 7A is a perspective view of the holder-attached terminal, with the upper lid shown closed.
Figure 7B:
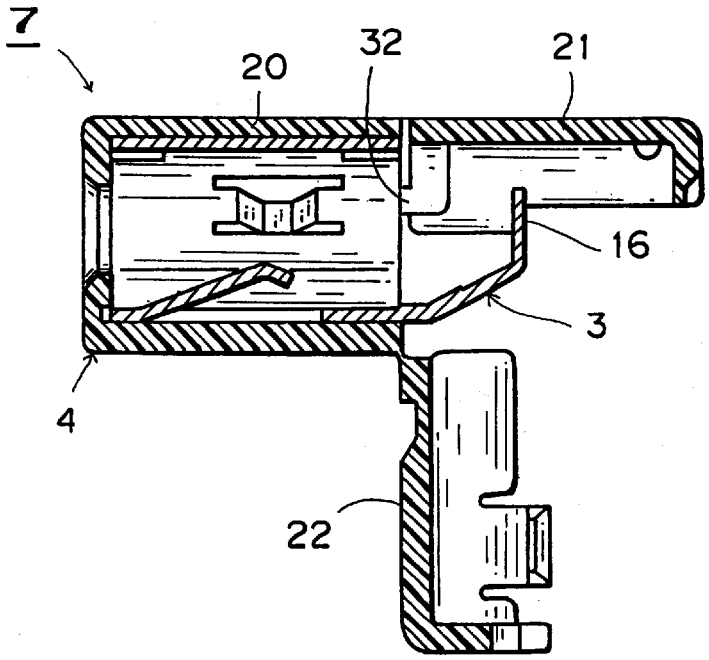
FIG. 7B is a sectional view of the holder-attached terminal.
Figure 8A:
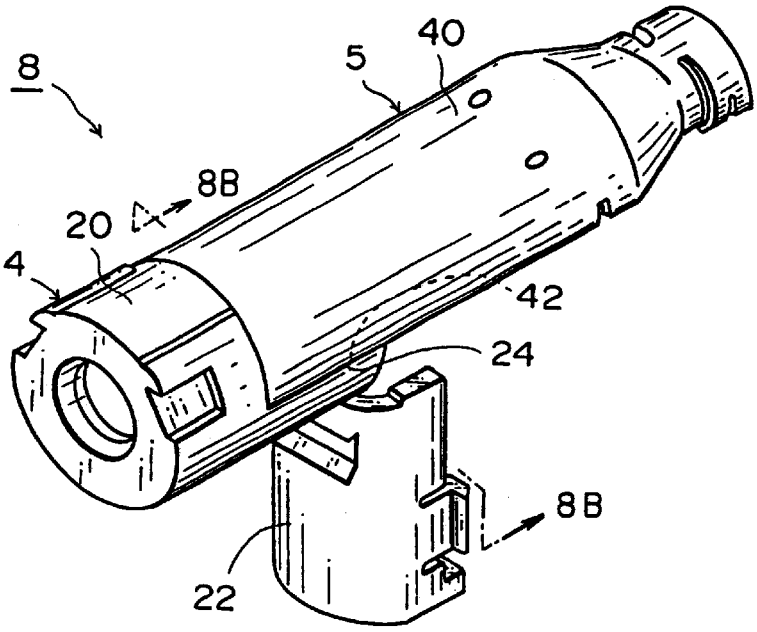
FIG. 8A is a perspective view of a cover-attached terminal assembled from more of the parts in FIG. 1.
Figure 8B:
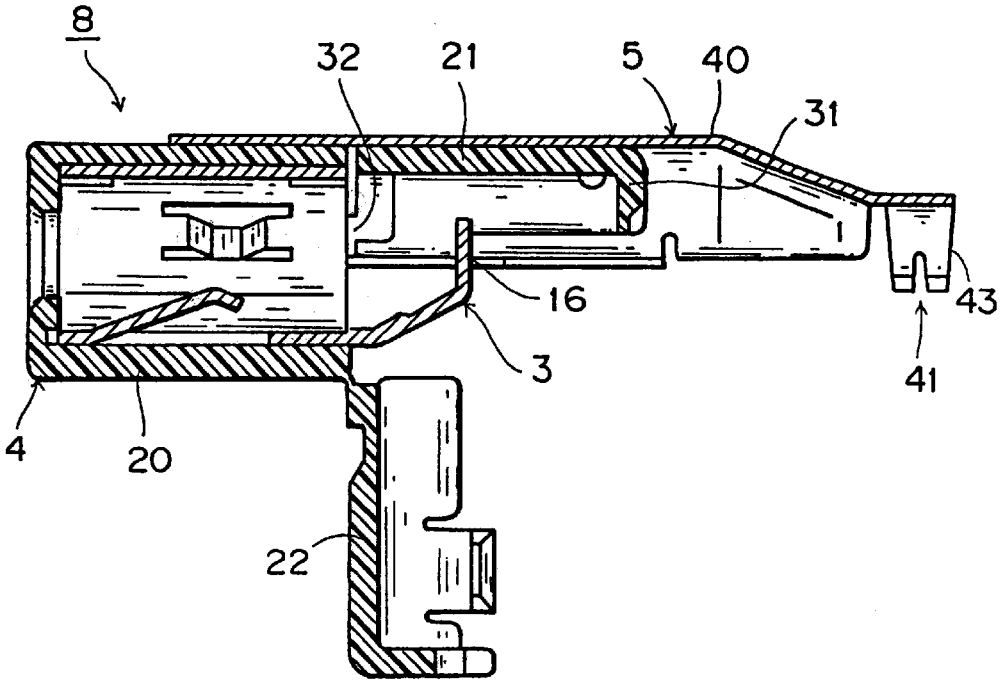
FIG. 8B is a sectional view of the cover-attached terminal.

A holder-attached terminal 7, as shown in FIGS. 6A and 6B, is provided by inserting the terminal 3 into the terminal receiving cavity 23 of the terminal holder 4 whose upper and lower lids 21 and 22 are opened. The upper lid 21 alone is then closed so that its pair of terminal locking projections 32, 32 abut against the terminal 3. The terminal 3 is thus locked in the terminal holder 4 and prevented from coming off rearwardly of the holder body 20.

Figure 9:
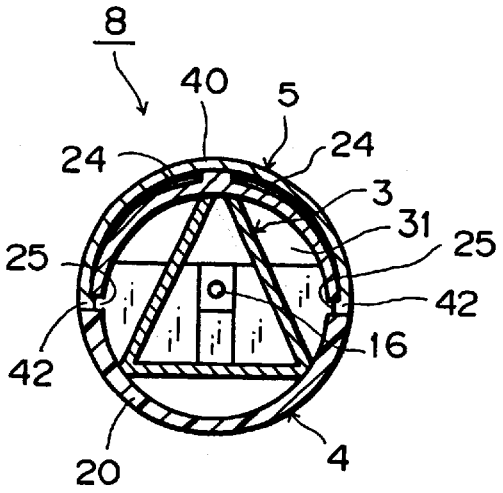
FIG. 9 is a sectional view taken along the line A—A of FIG. 8A.

A cover-attached terminal 8, as shown in FIGS. 7A, 7B, 8A and 8B, is then provided by pushing, with the lid 21 closed, the shield cover 5 along the placement recesses 24 and engaging the locking claws 42 provided at both lateral ends of the cover body 40 in the respective locking grooves 25 (FIG. 9). The front end of the cover body 40 is thus mounted on the rear end of the holder body 20, with its intermediate portion covering or superimposed on the upper lid 21, at which time the holder pieces 43 and the holding rib 31 of the upper lid 21 are longitudinally aligned with each other.

Figure 10:
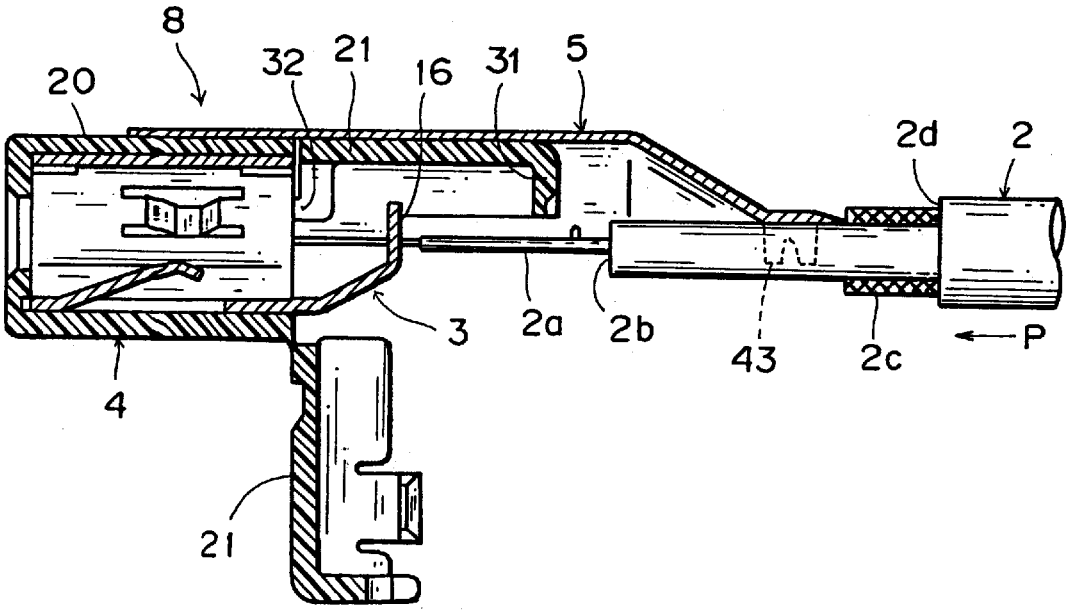
FIG. 10 is a sectional view of the cover-attached terminal, with a coaxial cable being pushed therein.
Figure 11:
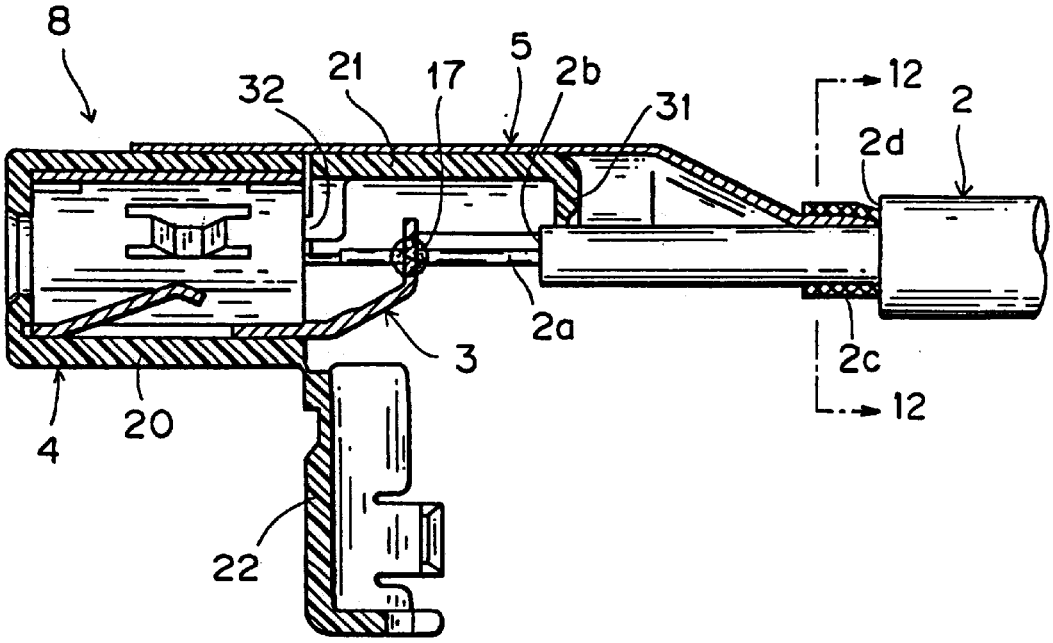
Figure 12:
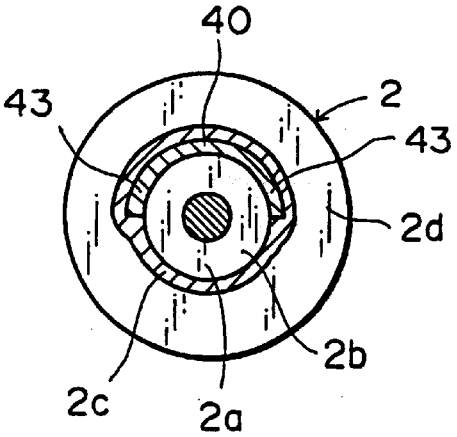
FIG. 12 is a sectional view taken along the line B—B of FIG. 11.

The coaxial cable 2, as shown in FIG. 10, is then pushed from the rear end side of the shield cover 5 toward the connection hole 16. As shown in FIGS. 11 and 12, the conductor 2*a* advances through between the pair of holder pieces 43, 43 (FIGS. 4A, 4B) into the connection hole 16. As the conductor 2*a* advances into the connection hole 16, the pair of holder pieces 43, 43 slide on the insulator 2*b* to get under and circumferentially raise the braid 2*c*, i.e., the pair of holder pieces 43, 43 are inserted in between the insulator 2*b* and the braid 2*c*. The conductor 2*a* and the braid 2*c* are thus positioned relative to the cover-attached terminal 8 at one time. At this time, the lower lid 22 is still in opened position.

Figure 13A:
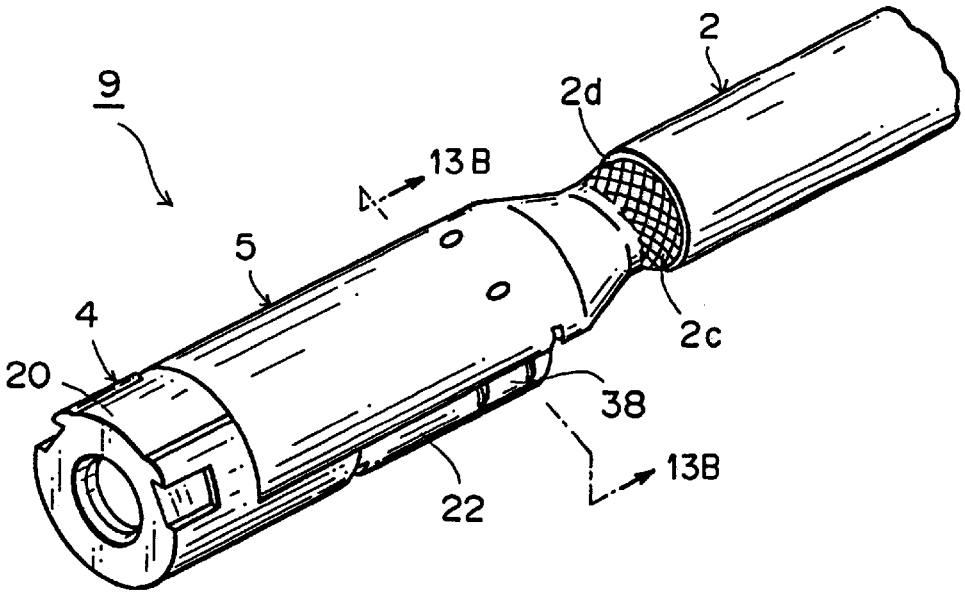
FIG. 13A is a perspective view of a terminal-attached cable assembled from yet more of the parts in FIG. 1.
Figure 13B:
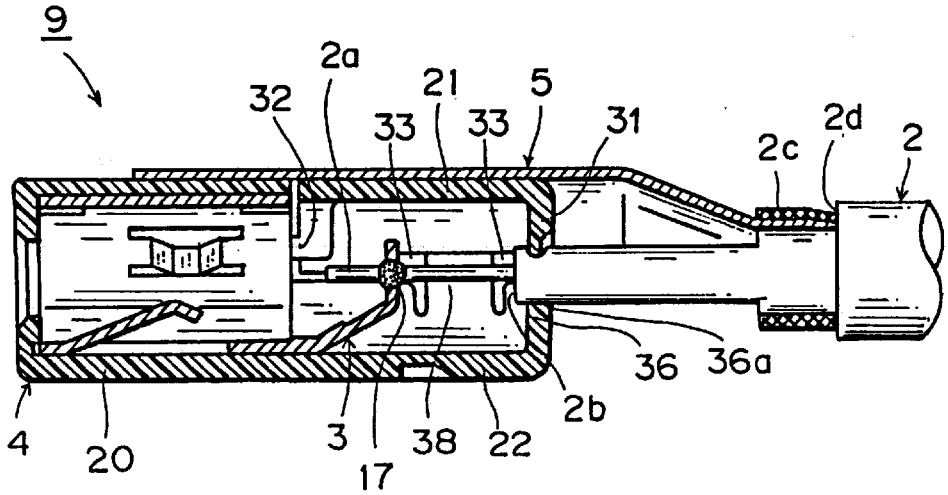
FIG. 13B is a sectional view of the terminal-attached cable.

Thereafter, a terminal-attached cable 9, as shown in FIGS. 13A and 13B, is produced by electrically connecting the conductor 2*a* to the terminal 3 at the connection hole 16 through soldering and closing the lower lid 22. On closing the lower lid 22, its cover-locking projections 38 deflects inwardly until they enter the receiving cutouts 33 and have their cover-locking claws 38*a* engaged with the respective locking claws 42 of the shield cover 5 (FIG. 14), at which time the holding rib 36 and the holding rib 31 hold the insulator 2*b* therebetween. The soldered connection 17 between the conductor 2*a* and the terminal 3 is located inside the closed upper and lower lids 21 and 22, with the insulator 2*b* held between the holding ribs 36 and 31 as mentioned above, and thus a reduction is made in the load on the conductor 2*a* during a subsequent operation or process. As a result, an improved reliability is attained in the electrical connection between the conductor 2*a* and the terminal 3.

Figure 15A:
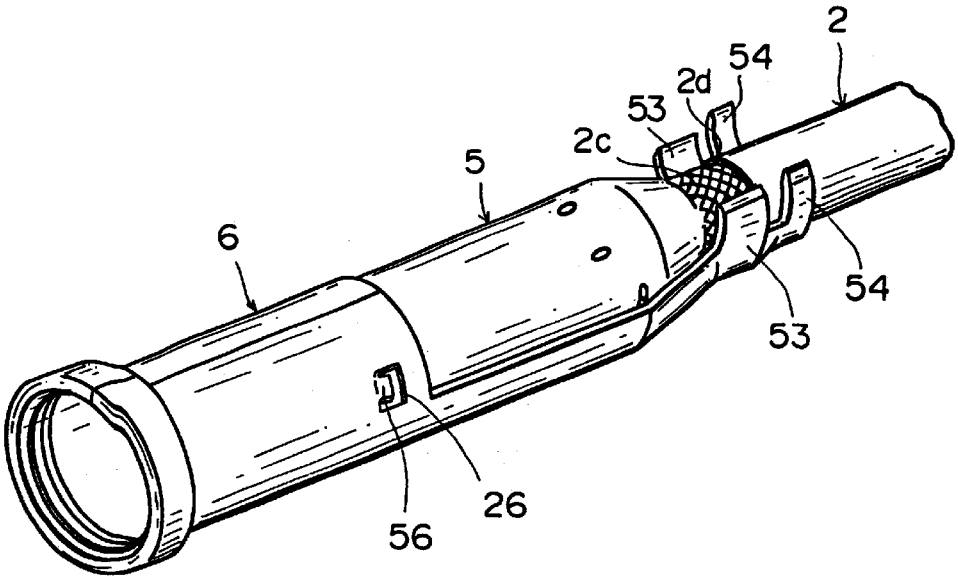
FIG. 15A is a perspective view of the terminal-attached cable being pushed in a sleeve in FIG. 1.
Figure 15B:
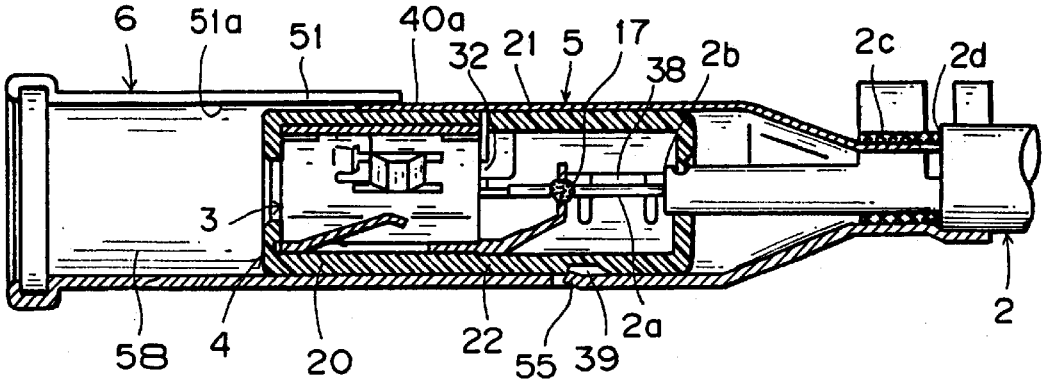
FIG. 15B is a sectional view of the terminal-attached cable.

As shown in FIGS. 15A and 15B, the terminal-attached cable 9 is pushed, with the terminal 3 side first, into the terminal receiving space 58 of the sleeve 6 until the locking grooves 26 engage the holder-locking pieces 56 and the positioning groove 39 engages the holder-positioning piece 55, thereby to assemble the terminal-attached cable 9 to the sleeve 6, at which time the outer surface 40*a* at the front end of the shield cover 5 comes into contact with the inner surface 51*a* of the cylindrical portion 51 of the sleeve 6 to make an electrical connection between the shield cover 5 and the sleeve 6.

Figure 16:
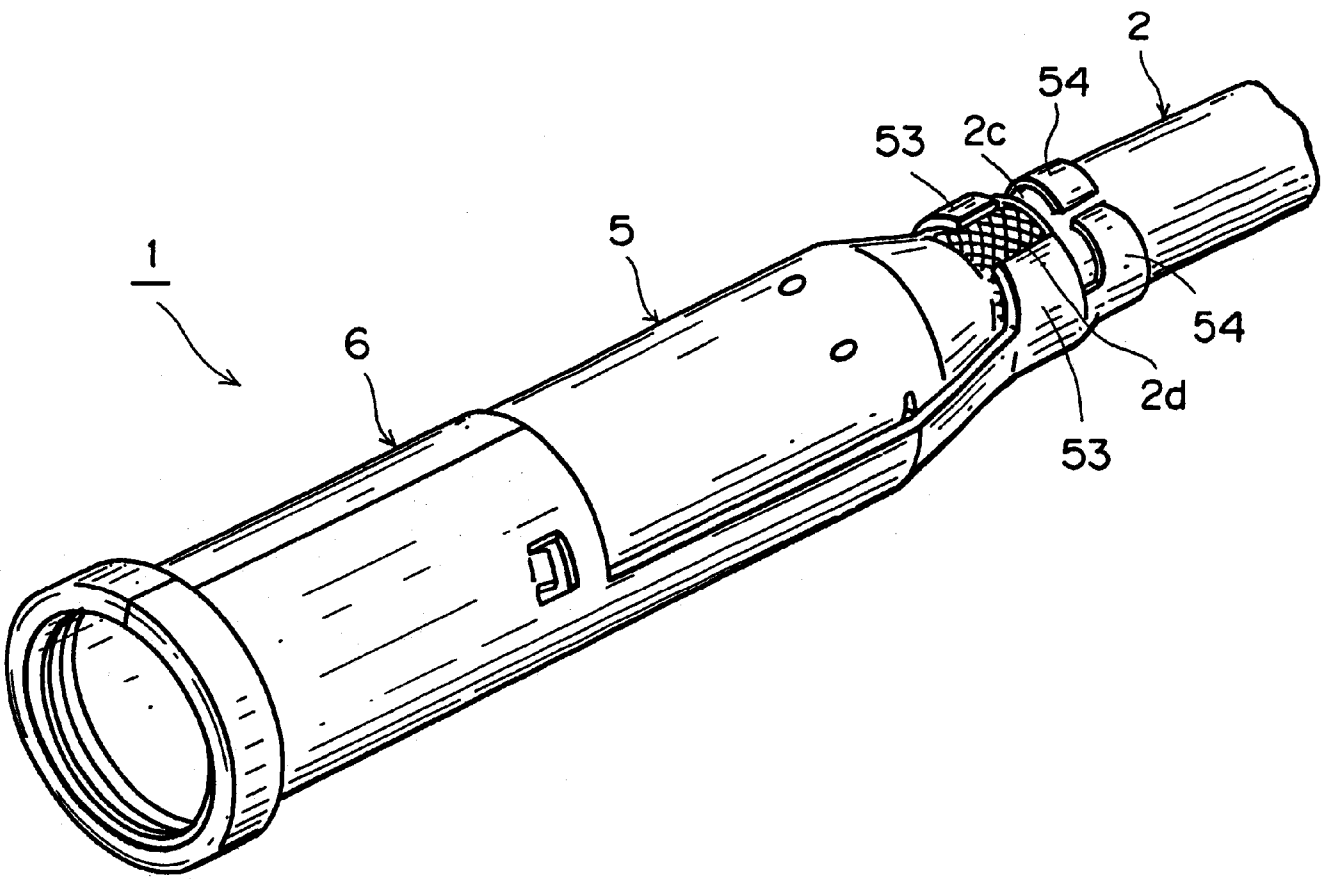
FIG. 16 is a perspective view of the connector for a coaxial cable fully assembled from the parts in FIG. 16.
Figure 17:
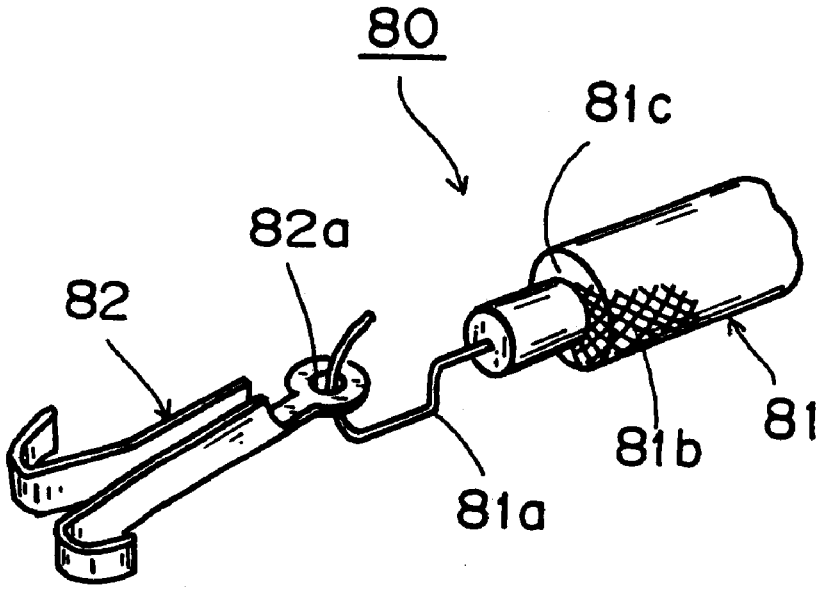
FIG. 17 PRIOR ART
FIG. 17 is an exploded perspective view of a conventional connector for a coaxial cable.
Figure 17:
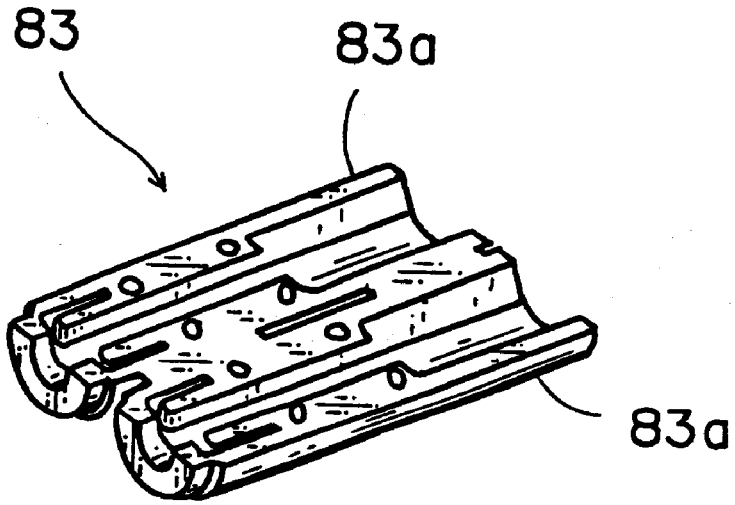
FIG. 17 PRIOR ART
Figure 18:
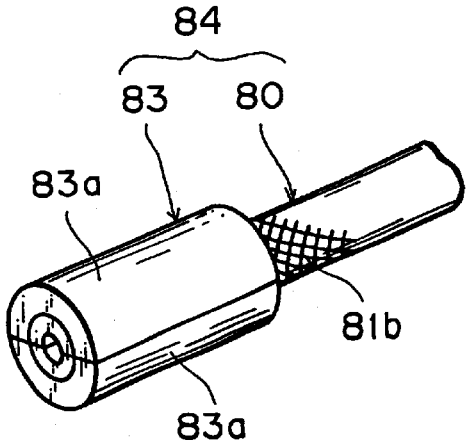
FIG. 18 PRIOR ART
FIG. 18 is a perspective view of a conventional terminal-attached cable.
Figure 19:
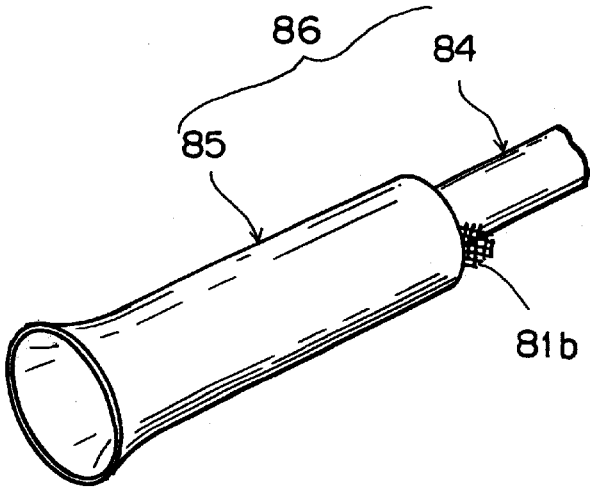
FIG. 19 PRIOR ART
FIG. 19 is a perspective view of a conventional connector-attached coaxial cable.
Figure 20:
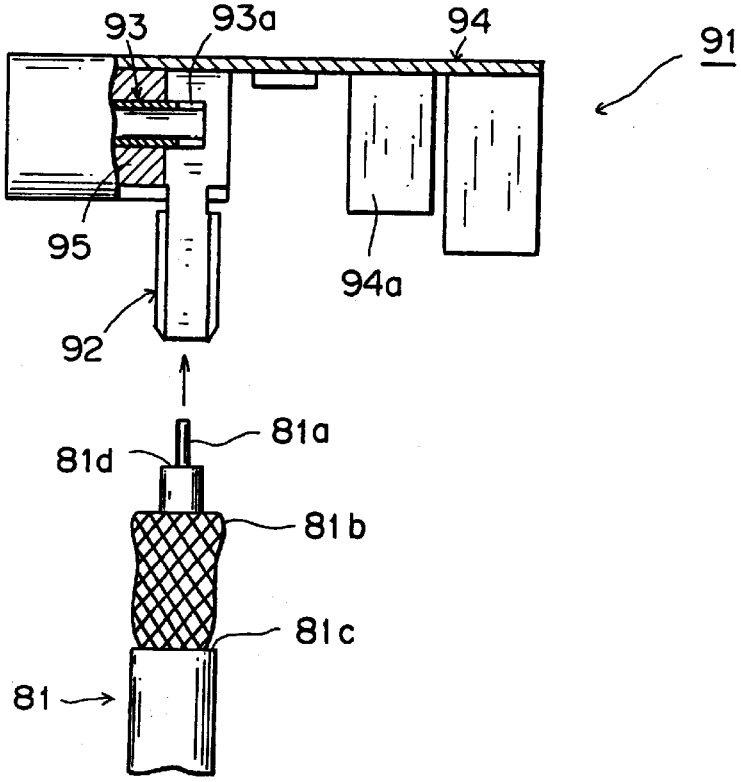
FIG. 20 PRIOR ART
FIG. 20 is a view of another conventional connector for a coaxial cable, with its housing and the coaxial cable shown separated.
Figure 21:
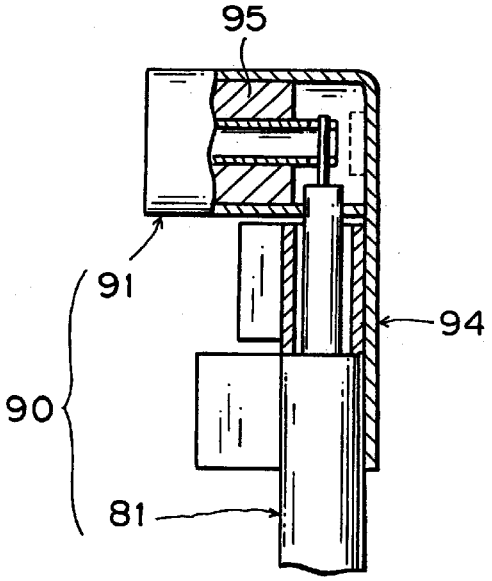
FIG. 21 PRIOR ART
FIG. 21 is a perspective view of the connector of FIG. 20, with the coaxial cable shown pushed into the housing.

As shown in FIG. 16, the pair of braid-holding pieces 53, 53 and the pair of sheath-holding pieces 54, 54 are crimped on the braid 2*c* and the sheath 2*d*, respectively, of the terminal-attached cable 9. The braid 2*c* is thus electrically connected to the sleeve 6, and the sheath 2*d* is mechanically connected to the sleeve 6, thereby to connect the connector 1 to the coaxial cable 2.

With this connection method, as described in connection with FIGS. 6 to 16, because the conductor 2*a* and the braid 2*c* are positioned at one time to provide the terminal-attached cable 9, and the terminal-attached cable 9 is thereafter assembled into the sleeve 6 as a single unit, the connector 1 is connected to the coaxial cable 2 in a simplified manner as compared with the described related art, making it possible to automate the connecting operation or process and attain an improved production efficiency.

Further, because load is prevented from being applied on the conductor 2*a* during and after connection of the connector 1, greater reliability is attained in the electrical connection between the conductor 2*a* and the terminal 3 than before. The product is thus maintained high quality.

Having now fully described the invention, it will be apparent to one of ordinary skill in the art that many changes and modifications can be made thereto without departing from the spirit and scope of the invention as set forth herein.

What is claimed is:

1. A connector for a coaxial cable, said coaxial cable including a conductor, an insulator around said conductor, a braid around said insulator, and a sheath around said braid, comprising:

a terminal provided with a connection hole into which said conductor of said coaxial cable is inserted for electrical connection with said terminal;

an insulating terminal holder including a holder body for receipt therein of said terminal and a pair of opposed first and second lids provided at one end of said holder body at a side wherefrom said terminal is received into said holder body, said first lid, when closed, locking said terminal in said holder; and a conductive shield cover including a substantially half cylinder shaped cover body detachably mounted on said terminal holder inclusive of said first lid in said closed position and a holding means provided at one end of said cover body toward said coaxial cable, said connection hole of said terminal and said holding means being longitudinally aligned with each other and said conductive shield cover being configured to allow said second lid to be open, when said cover body is mounted on said terminal holder, wherein when said coaxial cable is advanced toward said terminal, after said terminal is locked in said holder body by said first lid and said shield cover is mounted on said terminal holder, said conductor is inserted into said connection hole of said terminal and said braid is located on said holding means so as to position said conductor relative to said terminal and said braid relative to said shield cover at one time, and said second lid is then closed to cooperate with said first lid to hold said insulator therebetween.

2. The connector according to claim 1, further comprising a sleeve for receiving said terminal holder with said shield cover, said sleeve having a braid-holding means crimped on and connected to said braid located on said holding means.

3. The connector according to claim 1, wherein said holding means of said shield cover comprises a pair of opposed holding pieces having as a whole a shape equal to that of said insulator so as to get between said insulator and said braid on advancement of said coaxial cable toward said terminal.

4. The connector according to claim 1, wherein said first lid has at a side toward said holder body a terminal locking projection for locking said terminal in said holder body and at a side remote from said holder body a holding rib, and said second lid has at a side remote from said holder body a corresponding holding rib, said holding ribs of said first and second lids cooperating with each other to hold said insulator therebetween.

5. The connector according to claim 4, wherein one of said holding ribs of said first and second lids has a locking indentation for pressing therein said insulator when said holding ribs of said first and second lids hold said insulator therebetween.

6. The connector according to claim 1, wherein said second lid is lockingly engageable with said shield cover when said second lid is closed, through corresponding locking means provided on said second lid and said shield cover.

7. A method of connecting a connector to a coaxial cable, said coaxial cable including a conductor, an insulator around said conductor, a braid around said insulator, and a sheath around said braid, comprising the steps of:

inserting a terminal into an insulating terminal holder, said terminal having a connection hole into which said conductor of said coaxial cable is inserted;

locking said terminal in said terminal holder;

mounting a conductive shield cover on said terminal holder, which shield cover has a holding means, such that said connection hole of said terminal and said holding means are longitudinally aligned with each other; and advancing said coaxial cable along a straight line toward said terminal to have said conductor inserted into said connection hole of said terminal and said braid located on said holding means so as to position said conductor relative to said terminal and said braid relative to said shield cover at one time.

8. The method according to claim 7, further comprising the step of soldering said conductor to said terminal at said connection hole.

9. The method according to claim 7, further comprising the step of inserting said terminal holder with said shield cover into a sleeve provided with a braid-holding means, and crimping said braid-holding means on said braid located on said holding means of said shield cover.

* * * * *